United States Patent [19]

Bosserman et al.

[11] 4,020,376

[45] Apr. 26, 1977

[54] MINIATURE FLAT PANEL TWO MICROCHANNEL PLATE PICTURE ELEMENT ARRAY IMAGE INTENSIFIER TUBE

[75] Inventors: David A. Bosserman, Alexandria; Charles F. Freeman, Springfield, both of Va.

[73] Assignee: The United States of America as represented by the Secretary of the Army, Washington, D.C.

[22] Filed: Mar. 5, 1976

[21] Appl. No.: 664,219

[52] U.S. Cl. ..... 313/103 CM; 250/213 R; 313/105 CM; 313/400; 315/12 R

[51] Int. Cl.[2] ..... H01J 43/00; H01J 31/26; H01J 43/04

[58] Field of Search ..... 358/211, 241; 250/213 R, 213 VT; 313/373, 375, 377, 379, 387, 399, 400, 103 CM, 105; 315/12

[56] References Cited

UNITED STATES PATENTS

| | | | |
|---|---|---|---|
| 3,769,539 | 10/1973 | Catchpole | 313/377 |
| 3,885,180 | 5/1975 | Carts, Jr. | 313/103 |

*Primary Examiner*—Robert L. Richardson
*Attorney, Agent, or Firm*—Nathan Edelberg; Max L. Harwell; Robert P. Gibson

[57] ABSTRACT

A miniature flat panel image intensifier tube display device using two in-line microchannel plate (MCP) electron multipliers that have two arrays of orthogonally positioned electrically isolated parallel metallic stripes as electrodes on their interfacing surfaces and have the conventional continuous electrodes on the other two surfaces. A solid photocathode layer is in proximity focus with the solid input electrode of the first MCP, and the solid output electrode of the second MCP is in proximity focus with a display device. Array switching electronic means selectively switches bias voltages in some selected scan mode over the two arrays of MCP metallic stripes to provide a selective electron charge pattern exiting the second MCP wherein the charge pattern is converted to a visible image at the display device.

5 Claims, 2 Drawing Figures

MINIATURE FLAT PANEL TWO MICROCHANNEL PLATE PICTURE ELEMENT ARRAY IMAGE INTENSIFIER TUBE

The invention described herein may be manufactured, used, and licensed by or for the Government for governmental purposes without the payment of any royalty thereon.

BACKGROUND OF THE INVENTION

This invention is in the field of head mounted, or helmet mounted, image intensifiers that have information carrying video signal inputs thereto. Previously, miniature cathode ray tube image intensifiers have been used but these devices are restrictive to the needed field-of-view and whose weight is generally excessive.

SUMMARY

The present invention comprises a miniature flat panel image intensifier display tube having a first MCP electron multiplier and a second MCP electron multiplier positioned in-line and adjacent each other within said display tube wherein each of the interfacing surfaces of the MCP electron multipliers have an array of electrically isolated parallel metallic stripes as their respective biasing electrodes. The first MCP array and the second MCP array are orthogonal to each other. The photocathode on the inside of the transparent input faceplate is in proximity focus with a continuous input electrode on the first MCP, and a metallized phosphor screen on a transparent output faceplate is in proximity focus with a continuous output electrode of the second MCP.

An array switching electronic means is electrically connected to each of the metallic stripes for selectively applying differential bias voltages on each of the interfacing metallic stripes in some selective scan mode.

A suitable picture signal generator modulates a radiation source positioned on the front of the transparent input faceplate. Photons are emitted from the radiation source according to the signal intensity from the generator and these photons generate photoelectrons from the photocathode layer according to the photons pattern. The photoelectrons enter the channels of the first MCP electron multiplier causing secondary emission in the well known manner. The array switching electronic means creates an electronic charge pattern between the first and second MCP electron multipliers according to the differential bias voltages applied to the interfacing metallic stripes in some selected scan mode. The electronic charge pattern continues through the second MCP electron multiplier and impinges upon the metallized phosphor wherein the electronic charge pattern is converted to a visible image.

DETAILED DESCRIPTION OF THE PREFERRED EMBODIMENT

Figure 1:
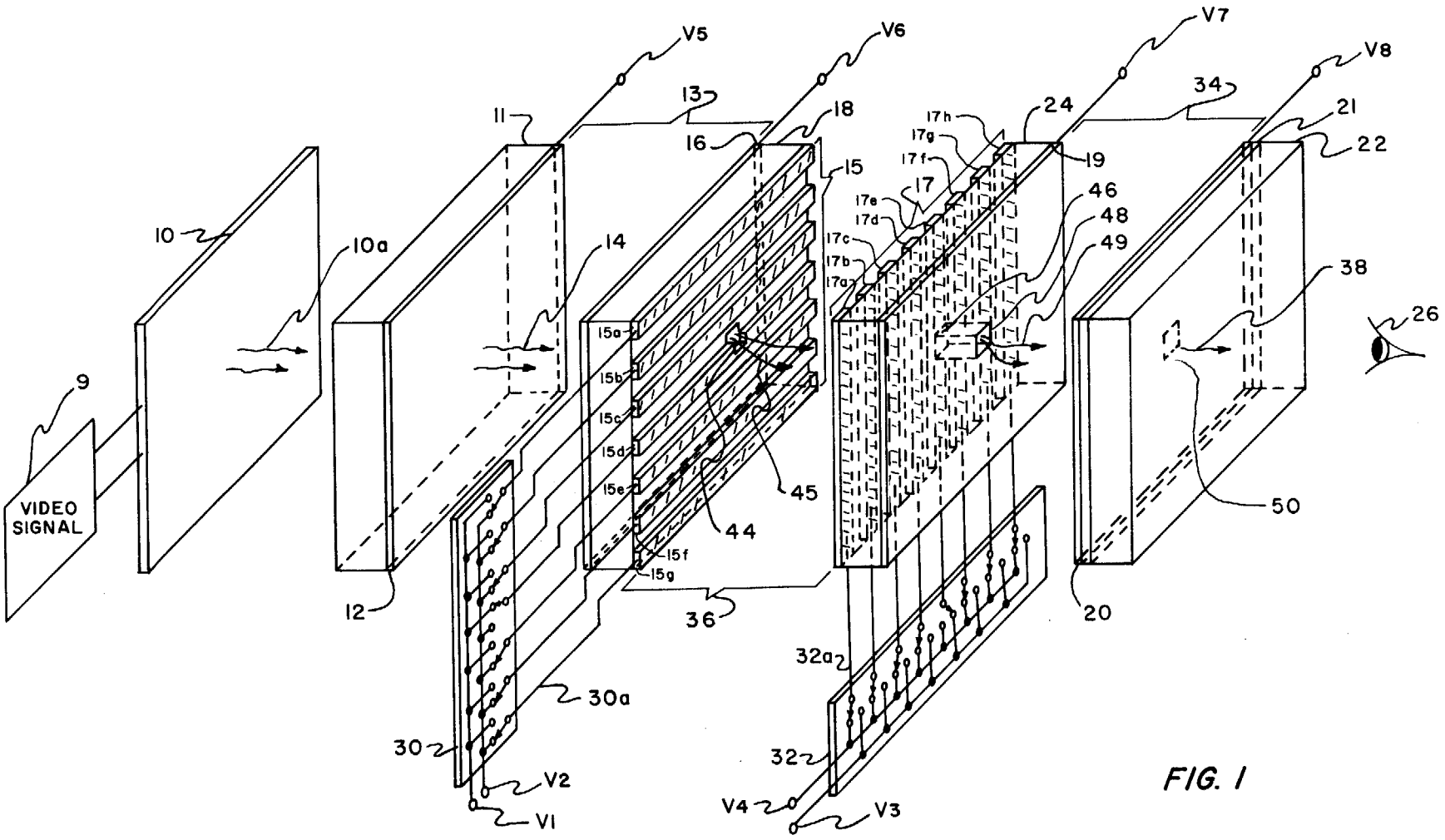
FIG. 1 is a schematic of the miniature flat panel image intensifier tube that emphasizes the addressable mosaic arrays between the two MCP electron multipliers.

FIG. 1 shows the basic embodiment of this invention with an addressable mosaic array of only 7 metallic stripes of the first MCP electron multiplier array and 8 metallic stripes of the second MCP electron multiplier array shown. However, there are many more of the metallic stripes used wherein the cross-over areas between the activated metallic stripes of the first MCP electron multiplier and the activated metallic stripes of the second MCP electron multiplier are known as activated picture elements or activated pixels.

Binary voltages V1 and V2 are shown as bias voltage inputs through first MCP array switching means 30 to the first MCP array 15, and binary voltages V3 and V4 are shown as binary voltage inputs through second MCP array switching means 32 to the second MCP array 17. One active pixel is discussed hereinbelow as being the activated cross-over area. However, it should be understood that this particular active pixel is only "on" at the instant and is in reality only one active pixel out of all of the other pixels that will be activated at some time during the entire sequence of some selected scan mode. The active pixel shown is at the cross-over area between metallic stripe **15*d* of the first MCP array and metallic stripe 17*e* of the second MCP array. Metallic stripes 15*d* and 17*e* have the activated or "on" bias voltages V1 and V3 respectively applied thereto as can be seen in the array switching electronic means 30 and 32. Voltages V2 and V3 are the inactive or "off" bias voltages when both are applied to cross-over areas of the metallic stripes of arrays 15 and 17**.

Various scan modes are available for switching the pixels. One scan mode address scheme is that of switching the "on" bias voltages V1 on one of its first MCP array metallic stripes, say **15*d*, while all of the second MCP array metallic stripes 17*a* through 17*h* have bias voltage V3 switched thereon in some scan mode. Conversely, bias voltage V3 may be applied to one of the second MCP array metallic stripes, say 17*e*, while all of the first MCP array metallic stripes 15*a* through 15*g*** have bias voltage V1 applied thereto in some scan mode. Many other scanning modes may be used such as scanning by groups of array stripes, sequential scanning, interlace sequential scanning, etc.

One active picture element, or pixel, represented by activated stripes **15*d* and 17*e* have a first MCP array pixel 44, a second MCP array pixel 46, a second MCP output pixel 48, and the phosphor pixel 50. Typical valves for bias voltages V1 through V4 are as follows: V1 is at ground potential; V3 is + 10 d.c. volts; V2 is +10 d.c. volts; and V4 is −10 d.c. volts. In other words, the "on" voltages V1 and V3 are a positive 10 d.c. volts that provide accelerating voltages for electrons 45 while the "off" voltages V2 and V4 present a repressive, or turn off, voltage of negative 20 d.c. volts to the electrons emitted from the first MCP electron multiplier 18. These voltages are appropriate for a very narrow proximity focus spacing between the two MCPs. A typical switching rate for 30 and 32** is at 5 MHz.

Figure 2:
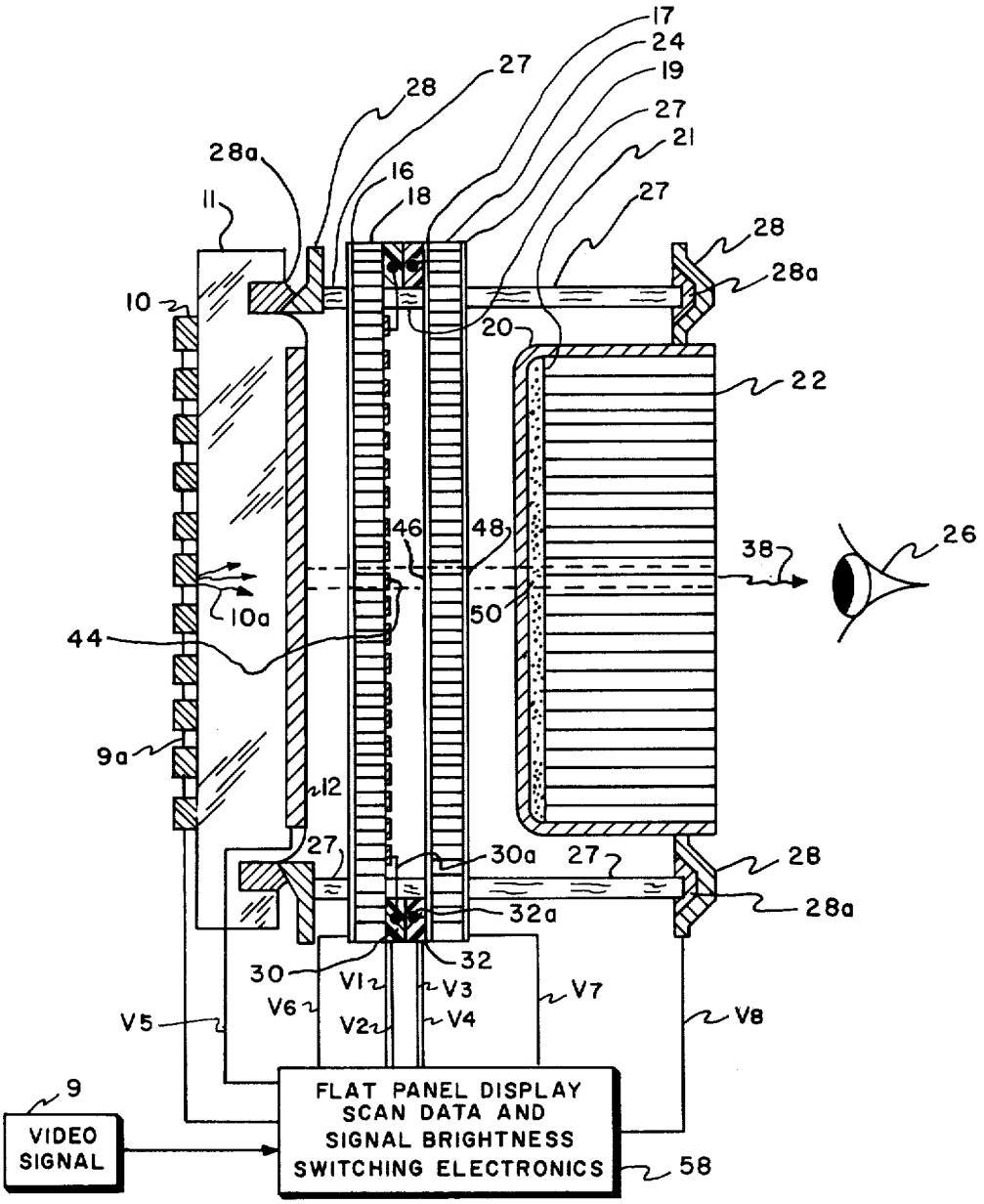
FIG. 2 shows a side view of the display tube.

Refer now to both FIGS. 1 and 2. The input means of the miniature flat panel image intensifier tube comprises a video picture signal generator 9, such as a television type video signal or computer input amplitude or brightness symbology signal, which signal is used to modulate a suitable radiation source 10 on the front of a transparent input faceplate 11. Source 10 may be a light emitting diode (LED) array with the LEDs electrically connected together by leads **9*a* to provide a uniform flow of photons therefrom. The modulated radiation, or stream of photons 10*a*, which are emitted from source 10, uniformly illuminate photocathode layer 12 mounted on the inside of faceplate 11. Faceplate 11 may be made of a transparent material such as glass or fiber optic. Photocathode layer 12** may be made of cesiated antimonide, such as S1 or S20 cathode material.

The modulated radiation 10*a* that is incident upon photocathode layer 12 causes a charge pattern of photoelectrons 14 to be emitted therefrom in accordance with the signal intensity from generator 9. The photoelectrons pass through continuous input electrode 16 of first MCP electron multiplier 18 and cause electron multiplication by secondary electron emission from the channel walls of 18 in the well known manner. The voltages V4 and V6, connected respectively to the photocathode layer 12 and to the continuous input electrode 16, provide a positive electric field through the photocathode to first MCP proximity focus space 13 for the charge pattern of photoelectrons. The number of multiplier electrons that exit first MCP 18 are according to bias voltages V1 through V4 which are switched on first MCP array 15 and second MCP array 17 respectively by 30 and 32, along leads 30*a* and 32*a*.

The multiplied electrons 45 that exit first MCP 18 at the first MCP array pixel 44 travel through the two MCP proximity focus space 36 for further amplification in second MCP 24 and out 24 to strike phosphor layer 21 at the active phosphor pixel 50. The electrons pass through a very thin metallized phosphor electrode 20. The phosphor layer 21 is contiguous with a transparent output faceplate 22, which may be made of glass or fiber optic. An observer, represented by eye 26 may directly view a visible image, represented by numeral 38, produced by electrons striking phosphor layer 21.

A voltage V7 is connected to the continuous output electrode 19 of the second MCP, and bias voltage V8 is connected to the metallized phosphor electrode 20 to produce an electric field in second MCP to screen proximity focus space 34. The voltage difference between V7 and V8 may be about 50 kilovolts depending on the distance across space 34. Also, space 34 may be arranged to permit the individual "on" pixels to spread until they overlap on the phosphor layer 21 to avoid the mosaic pattern effect. Typical bias voltages for V5 and V6 are as follows. V6 is about a negative 1,000 d.c. volts while V5 is a negative 1,150 d.c. volts wherein V5 and V6 form a first bias voltage means. Voltages V7 and V8 form a second bias voltage means.

The miniature flat panel image intensifier tube is shown in its vacuum environment in FIG. 2. The vacuum is formed inside the annular flanges 28 and connecting collars 27 that embutt flanges 28 and the first and second MCPs. Collars 27 are electrical insulators, such as glass, quartz, or ceramic. Flanges 28 may be made of any good conductor material and are connected to collars 27, to the input faceplate 11, and to electrode 20 on output faceplate 22 by indium seal or welded seal 28*a*. If both MCPs 18 and 24 and collars 27 are made of glass, they may easily be fused together.

The array switching electronic means 58, the switching means 30 and 32, the picture signal generator 9, and radiation source 10 are preferably positioned outside the vacuum environment. The picture signal generator 9 may produce a television type signal or may be a computer producing symbology whose output is applied to 58. Electronic means 58, in turn, modulates radiation source 10 with the pixel brightness from signal generator 9 and also controls both switching circuits 30 and 32 with a scan data signal input thereto. Circuits 30 and 32 may be solid state shift registers or a charge coupled device on one chip that directly control the pixel first and second MCP arrays 15 and 17 and may conventinetly be tailored to the picture signal generator 9, such as matching the video raster.

It should be understood that the foregoing disclosure relates to only a preferred embodiment of the invention and numerous modifications or alterations may be made therein without departing from the spirit and the scope of the invention as set forth in the appended claims.

We claim:

1. A miniature flat panel picture element array image intensifier tube comprising:

a video picture signal generator for providing a video signal;

a radiation source, said radiation source being modulated by said video signal for creating a generally uniform flow of photons therefrom with said radiation source mounted on the front of a transparent input faceplate;

a photocathode layer on the inside of said input faceplate;

a first microchannel plate electron multiplier having a continuous input electrode in proximity focus with said photocathode layer and having as an output electrode an array of electrically isolated parallel output electrode metallic stripes;

a second microchannel plate electron multiplier have as an input electrode an array of electrically isolated parallel input electrode metallic stripes that are positioned close to the array of first microchannel plate output electrode metallic stripes and are orthogonal to each other and having a continuous output electrode;

a metallized phosphor screen mounted on the inside of a transparent output faceplate wherein said metallized phosphor screen is adjacent said second microchannel plate continuous output electrode and in proximity focus therewith;

a first bias voltage means connected across said photocathode layer and said first microchannel plate continuous input electrode for accelerating photoelectrons emitted from said photocathode layer to said first microchannelplate;

a second bias voltage means connected across said second microchannel plate continuous output electrode and said metallized phosphor screen for providing proximity focus between said second microchannel plate and said metallized phosphor screen; and an array switching electronic means for switching bias voltages in some selected scan mode over said first microchannel plate array of output electrode metallic stripes and said second microchannel plate array of input electrode metallic stripes for selectively providing accelerating voltages between crossover stripes that have forward bias voltages applied thereto wherein repressive bias voltages exist on all other cross-over stripes that have reverse bias voltages applied thereto whereby electrons multiplied in said first microchannel plate enter the channels of said second microchannel plate in a charge pattern determined by said scan mode whereby the electrons that exit said channels of said second microchannel plate are converted into visible energy on said metallized phosphor screen for producing a visible image of said video signal according to said scan mode.

2. An image intensifier tube as set forth in claim 1 wherein said radiation source is a plurality of light emitting diodes electrically connected together.

3. An image intensifier tube as set forth in claim 2 wherein said array switching electronic means is solid state circuitry that controls a solid state first microchannel plate switching means and a solid state second microchannel plate switching means that sequentially switch said bias voltages in said scan mode on all crossover pixels between said first microchannel plate array of output electrode metallic stripes and said second microchannel plate array of input electrode metallic stripes.

4. An image intensifier tube as set forth in claim 3 wherein said solid state circuitry comprises a charge coupled device having an input thereto from said video signal and seven outputs therefrom wherein a first output controls the brightness level of said radiation source according to the brightness level of said video signal and second and third outputs provide bias voltages of said first bias voltage means to said photocathode and to said first microchannel plate continuous input electrode and fourth and fifth outputs provide bias voltages of said second bias voltage means to said second microchannel plate continuous output electrode and to said metallized phosphor screen and sixth and seventh outputs control said solid state first microchannel plate switching means and said solid state second microchannel plate switching means and the bias voltages provided thereto for selectively accelerating electrons from said first microchannel plate into a charge pattern entering said channels of said second microchannel and for converting said charge pattern into visible energy on said metallized phosphor screen.

5. An image intensifier as set forth in claim 4 wherein said solid state first and second microchannel plate switching means are shift registers.

* * * * *